US007611363B2

(12) United States Patent
Nakamura

(10) Patent No.: US 7,611,363 B2
(45) Date of Patent: Nov. 3, 2009

(54) CONNECTOR

(75) Inventor: Masatoshi Nakamura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/327,928

(22) Filed: Dec. 4, 2008

(65) Prior Publication Data

US 2009/0149046 A1 Jun. 11, 2009

(30) Foreign Application Priority Data

Dec. 5, 2007 (JP) ..... 2007-314381

(51) Int. Cl.
*H01R 13/648* (2006.01)

(52) U.S. Cl. ..... 439/108; 439/579

(58) Field of Classification Search ..... 439/578, 439/579, 585, 108, 98
See application file for complete search history.

(56) References Cited

U.S. PATENT DOCUMENTS

| | | | | |
|---|---|---|---|---|
| 3,985,416 | A * | 10/1976 | Dola et al. | 439/403 |
| 4,701,001 | A * | 10/1987 | Verhoeven | 439/394 |
| 4,749,365 | A * | 6/1988 | Magnifico et al. | 439/396 |
| 4,749,366 | A * | 6/1988 | McCaffery | 439/396 |
| 4,799,900 | A * | 1/1989 | Capp et al. | 439/585 |
| 4,973,258 | A * | 11/1990 | Fusselman | 439/98 |
| 5,205,761 | A * | 4/1993 | Nilsson | 439/578 |
| 5,636,306 | A * | 6/1997 | Mock et al. | 385/101 |
| 5,746,610 | A * | 5/1998 | Shiu | 439/98 |
| 5,864,090 | A * | 1/1999 | Wright | 174/40 CC |
| 6,155,847 | A * | 12/2000 | Wright | 439/98 |
| 6,165,003 | A * | 12/2000 | Bigotto | 439/406 |
| 6,297,447 | B1 * | 10/2001 | Burnett et al. | 174/40 CC |
| 6,398,563 | B1 * | 6/2002 | Kanagawa et al. | 439/98 |
| 6,659,781 | B2 * | 12/2003 | Miyazaki | 439/98 |
| 6,837,735 | B1 * | 1/2005 | Dessein et al. | 439/394 |
| 6,890,191 | B1 * | 5/2005 | Thorburn | 439/98 |
| 6,960,097 | B2 * | 11/2005 | Morishita | 439/404 |
| 6,988,911 | B2 * | 1/2006 | McCarthy et al. | 439/578 |
| 7,048,586 | B2 * | 5/2006 | Ishizaki et al. | 439/607.44 |
| 7,059,875 | B2 * | 6/2006 | Kunimoto | 439/95 |
| 7,059,889 | B1 * | 6/2006 | Pavlovic et al. | 439/397 |
| 7,134,903 | B1 * | 11/2006 | Pavlovic | 439/404 |
| 7,220,146 | B2 * | 5/2007 | Miyazaki | 439/579 |
| 7,354,294 | B2 * | 4/2008 | Kawate et al. | 439/394 |
| 7,371,111 | B2 * | 5/2008 | McCarthy et al. | 439/578 |
| 7,377,801 | B2 * | 5/2008 | Sakaguchi | 439/394 |
| 2004/0166731 | A1 * | 8/2004 | Laub et al. | 439/578 |
| 2006/0141829 | A1 * | 6/2006 | Kauth | 439/98 |
| 2006/0246776 | A1 * | 11/2006 | Itou et al. | 439/579 |
| 2007/0155230 | A1 * | 7/2007 | Kawate et al. | 439/578 |

FOREIGN PATENT DOCUMENTS

JP 2003-068406 A 3/2003

* cited by examiner

*Primary Examiner*—Ross N Gushi
(74) *Attorney, Agent, or Firm*—Sughrue Mion, PLLC

(57) ABSTRACT

A connector 1 is comprised of a shield terminal 2, a grounding plate 3, and a connector housing 4. The grounding plate 3 is formed in an L-shape having a terminal connecting plate portion 6 and an external connecting plate portion 7. An outer conductor terminal press-fitting slit 8 is formed in the terminal connecting plate portion 6, and a pair of retaining projections 9 are formed on the terminal connecting plate portion 6. The outer conductor terminal press-fitting slit 8 has formed therein a terminal introducing portion 11 as a portion for introducing the cylindrical outer conductor terminal 5 of the shield terminal 2, a terminal crimping portion 12 continuing from this terminal introducing portion 11 and adapted to crimp the cylindrical outer conductor terminal 5 in such a manner as to clamp it, and a slit-width enlargement action portion 13 continuing from the terminal crimping portion 12.

4 Claims, 7 Drawing Sheets

CONNECTOR

BACKGROUND OF THE INVENTION

1. Field of the Invention

The present invention relates to a connector having a shield terminal, a grounding plate, and a connector housing.

2. Description of the Related Art

Patent document 1 described below discloses a technique concerning a connector that is provided at a terminal of a coaxial cable and is fixed to a chassis. The connector has a shield terminal, and this shield terminal has an outer conductor terminal that is connected to a braid of the coaxial cable. The outer conductor terminal has an outer conductor terminal body having a grounding plate integrated therewith for grounding to the chassis, as well as an auxiliary case which is subsequently attached to this outer conductor terminal body.

Since the outer conductor terminal body has the grounding plate integrated therewith, the outer conductor terminal body is formed into a complex shape. In addition, since the outer conductor terminal body is formed in a complex shape, the structure adopted is such that the auxiliary case is required. It should be noted that as the grounding plate is integrated, an instantaneous interruption does not occur with respect to the grounding plate owing to the displacement of the shield terminal.

Patent Document 1: JP-A-2003-68406

The above-described conventional technique has a problem in that the outer conductor terminal disadvantageously becomes complex in exchange for ensuring high connection reliability. As the outer conductor terminal is formed in a complex shape, there is a problem in that it goes without saying that the manufacturability of the shield terminal and the connector becomes aggravated, and the efficiency in the mounting operation is also affected.

SUMMARY OF THE INVENTION

The invention has been devised in view of the above-described circumstances, and its object is to provide a connector that excels in manufacturability and operational efficiency and exhibits high connection reliability.

To attain the above object, in accordance with a first aspect of the invention there is provided a connector comprising: a shield terminal provided at a terminal of a coaxial cable and having on its outer side an electrically conductive cylindrical outer conductor terminal; an electrically conductive grounding plate having a terminal connecting plate portion which is brought into contact with the cylindrical outer conductor terminal and an external connecting plate portion which is exposed to an outside of the connector; and an insulating connector housing having a terminal inserting/accommodating portion which has a shape of a circular through hole and into which the shield terminal is inserted and is accommodated and a plate inserting/accommodating portion into which the terminal connecting plate portion is inserted in such a way as to traverse the terminal inserting/accommodating portion and is accommodated, wherein an outer conductor terminal press-fitting slit which has a terminal introducing portion for introducing the cylindrical outer conductor terminal, a terminal crimping portion continuing from the terminal introducing portion and adapted to crimp the cylindrical outer conductor terminal in such a manner as to clamp the cylindrical outer conductor terminal, and a slit-width enlargement action portion continuing from the terminal crimping portion is formed in the terminal connecting plate portion.

According to the above-described first aspect of the invention, first, if the shield terminal is inserted into the terminal inserting/accommodating portion of the connector housing, the inserted state of the shield terminal is held with its cylindrical outer conductor terminal contacting an inner surface of the terminal inserting/accommodating portion. Next, when the terminal connecting plate portion is accommodated in such a manner as to insert the terminal connecting plate portion of the grounding plate into the plate inserting/accommodating portion of the connector housing, at this time the cylindrical outer conductor terminal is thrust into the outer conductor terminal press-fitting slit of the terminal connecting plate portion, and the terminal connecting plate portion and the cylindrical outer conductor terminal are connected to each other by crimping. The cylindrical outer conductor terminal is crimped in a state of being clamped by the terminal crimping portion of the outer conductor terminal press-fitting slit. Since the terminal connecting plate portion comes to possess a spring characteristic by virtue of the configuration of the outer conductor terminal press-fining slit, the terminal connecting plate portion is resiliently connected to the cylindrical outer conductor terminal. As the shield terminal is crimped by the terminal connecting plate portion, the shield terminal is held inside the connector housing in a state of being difficult to be displaced. The grounding plate whose connection to the cylindrical outer conductor terminal is completed is grounded to, for instance, a bracket or the like through the external connecting plate portion which is exposed to the outside of the connector.

In accordance with a second aspect of the invention, in the connector according to the above-described first aspect of the invention, an outer surface-side plate accommodating portion for accommodating the external connecting plate portion is formed in an outer surface of the connector housing, the outer surface-side plate accommodating portion being formed such that the external connecting plate portion becomes flush with the outer surface in a state in which the terminal connecting plate portion is fully inserted into the plate inserting/accommodating portion.

According to the above-described second aspect of the invention, when the external connecting plate portion of the grounding plate is flush with the outer surface of the connector housing, the terminal connecting plate portion of the grounding plate and the cylindrical outer conductor terminal of the shield terminal are connected to each other inside the connector housing by crimping. In contrast, in a case where the external connecting plate portion is not flush with the outer surface of the connector housing, the above-described crimping is not completed.

In accordance with a third aspect of the invention, in the connector according to the above-described first or second aspect of the invention, a retaining projection projecting in a widthwise direction of the terminal connecting plate portion are formed on the terminal connecting plate portion, and a plate retaining recess for retaining the retaining projection is formed in the connector housing by a die-cut slot which reaches the plate inserting/accommodating portion.

According to the above-described third aspect of the invention, if the terminal connecting plate portion is accommodated in the plate inserting/accommodating portion 22 in such a manner as to insert the terminal connecting plate portion into the plate inserting/accommodating portion of the connector housing, at this time the retaining projection of the terminal connecting plate portion is retained by the plate retaining recess of the plate inserting/accommodating portion, thereby fixing the position of the grounding plate. As a result, the shield terminal is held inside the connector housing in a state of being more difficult to be displaced.

In accordance with a fourth aspect of the invention, in the connector according to the above-described third aspect of the invention, the plate retaining recess is formed into such a shape that a jig inserting space is formed between the retaining projection and the plate retaining recess in a state in which the retaining projection is retained.

According to the above-described fourth aspect of the invention, the disassembly of the connector becomes possible if the state of retention between the retaining projection and the plate retaining recess is released by inserting the retention releasing jig into the jig inserting space. By making use of the die-cut slot which reaches the plate inserting/accommodating portion, there is no need to design an exclusive-use structure for the retention releasing jig.

According to the first aspect of the invention, since the shield terminal and the grounding plate are separate, an advantage is offered in that it is possible to improve the manufacturability of the shield terminal over conventional examples. In addition, according to the invention, since the assembling structure is such that the shield terminal and the grounding plate are inserted into the connector housing, an advantage is offered in that the connector can be made easy to operate. Further, according to the invention, since the terminal connecting plate portion and the cylindrical outer conductor terminal are brought into pressure contact with each other for crimping, and the terminal connecting plate portion is resiliently connected to the cylindrical outer conductor terminal, an advantage is offered in that the connector can be made highly reliable in connection. Furthermore, according to the invention, since the holding structure of metals is adopted in which the shield terminal is held by the grounding plate, an advantage is offered in that the connector can be provided with a high terminal holding force.

According to the second aspect of the invention, an advantage is offered in that the state of connection inside the connector housing can be grasped by the position of the external connecting plate portion, According to the third aspect of the invention, an advantage is offered in that the shield terminal can be held inside the connector housing in a state of being more difficult to be displaced.

According to the fourth aspect of the invention, the disassembly of the connector can be performed easily if the state of retention between the retaining projection and the plate retaining recess is released through the jig inserting space. As a result, an advantage is offered in that the connector can be made highly recyclable. In addition, by making use of the die-cut slot which reaches the plate inserting/accommodating portion, an advantage is offered in that there is no need to design an exclusive-use structure for the retention releasing jig.

BRIEF DESCRIPTION OF THE DRAWINGS

FIGS. 1A and 1B are diagrams illustrating an embodiment of the connector in accordance with the invention, in which FIG. 1A is a cross-sectional view illustrating the configuration of the connector and FIG. 1B is a perspective view (the inside of a circle is an enlarged view of essential portions) of a grounding plate;

FIGS. 2A and 2B are diagrams illustrating a connector housing, in which FIG. 2A is a perspective view and FIG. 2B is a cross-sectional view at the position of a terminal inserting/accommodating portion;

DESCRIPTION OF THE PREFERRED EMBODIMENTS

Figure 1A:
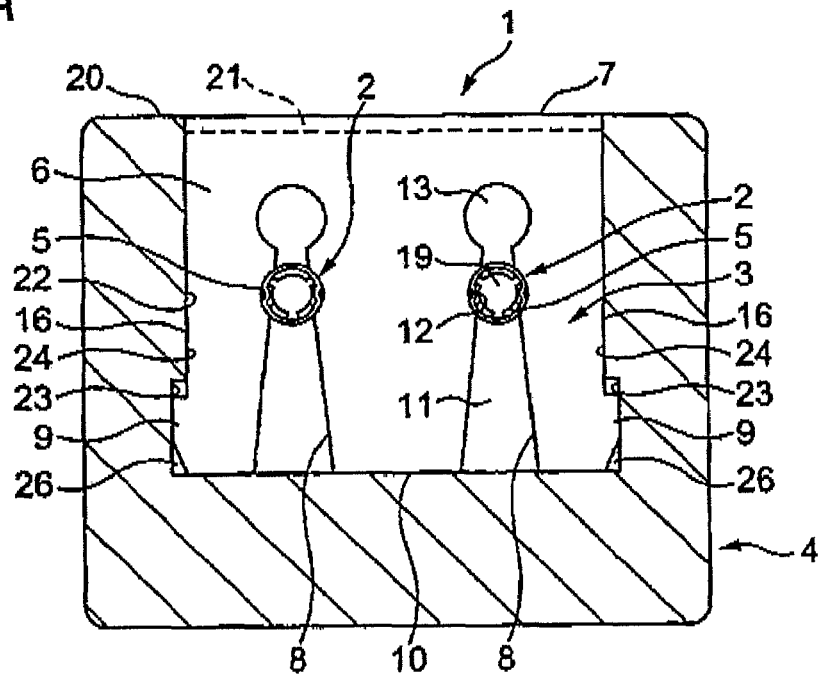
Figure 1B:
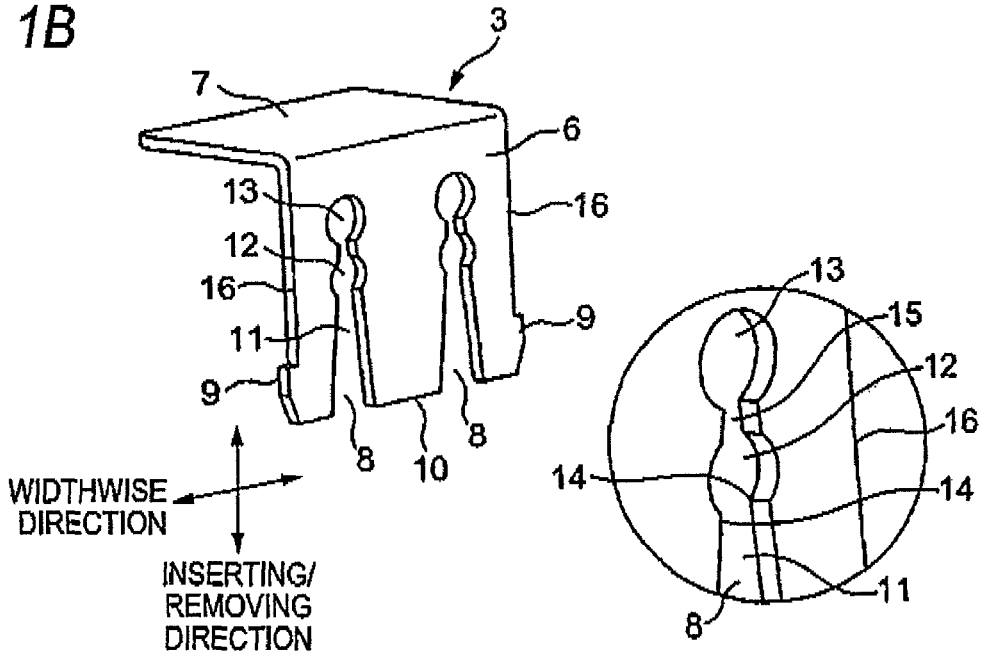
Figure 2A:
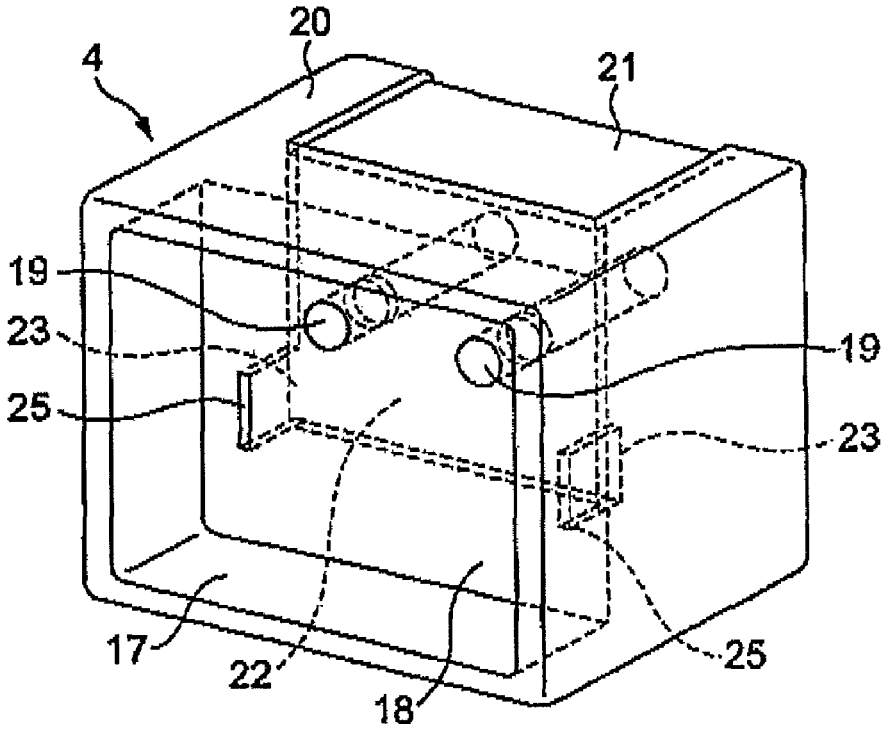
Figure 2B:
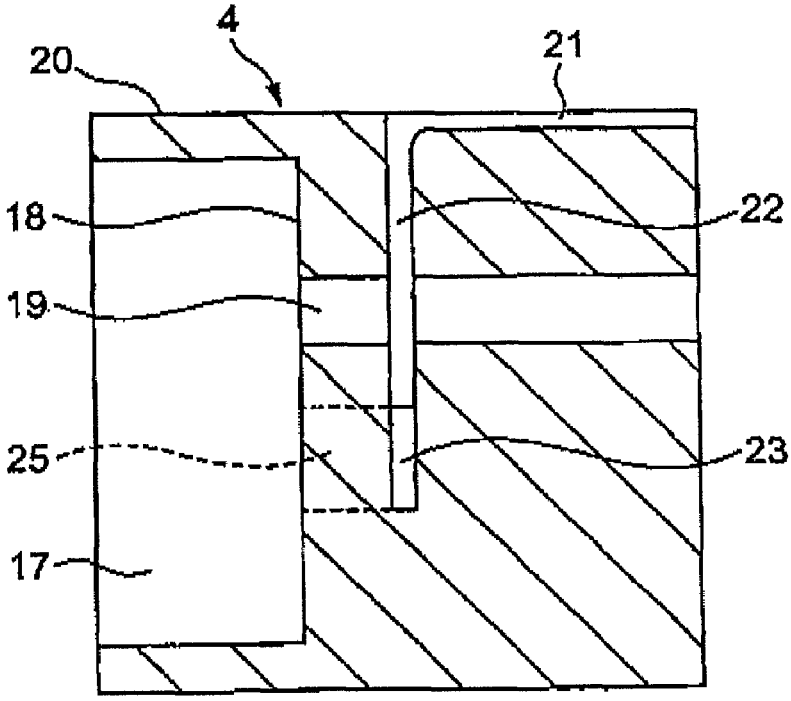
Figure 3:
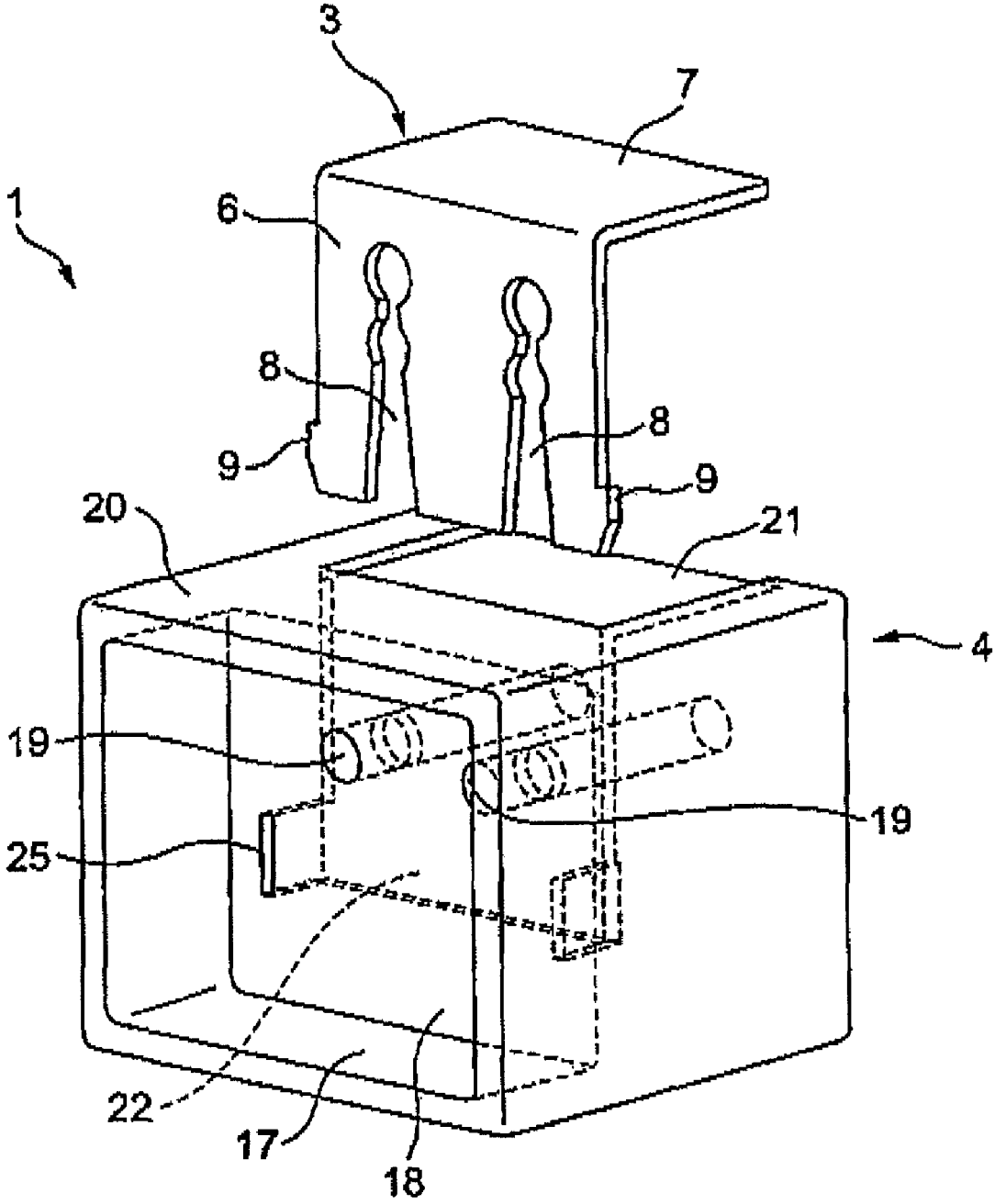
FIG. 3 is a diagram concerning the assembly of the connector and is a perspective view illustrating a state immediately prior to the insertion of the grounding plate into the connector housing.
Figure 4:
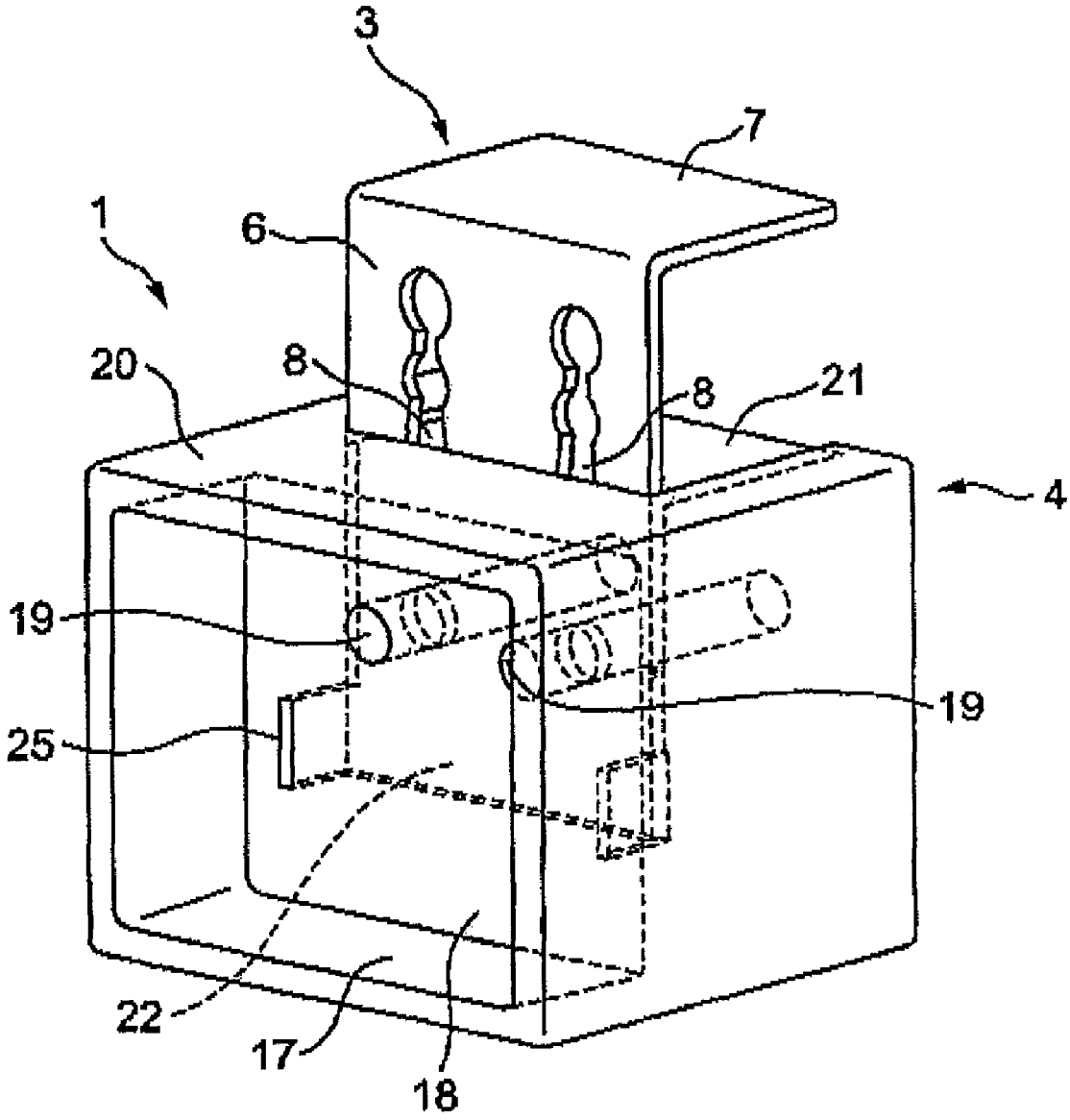
FIG. 4 is a diagram concerning the assembly of the connector and is a perspective view illustrating a state in which the grounding plate is inserted halfway into the connector housing.
Figure 5:
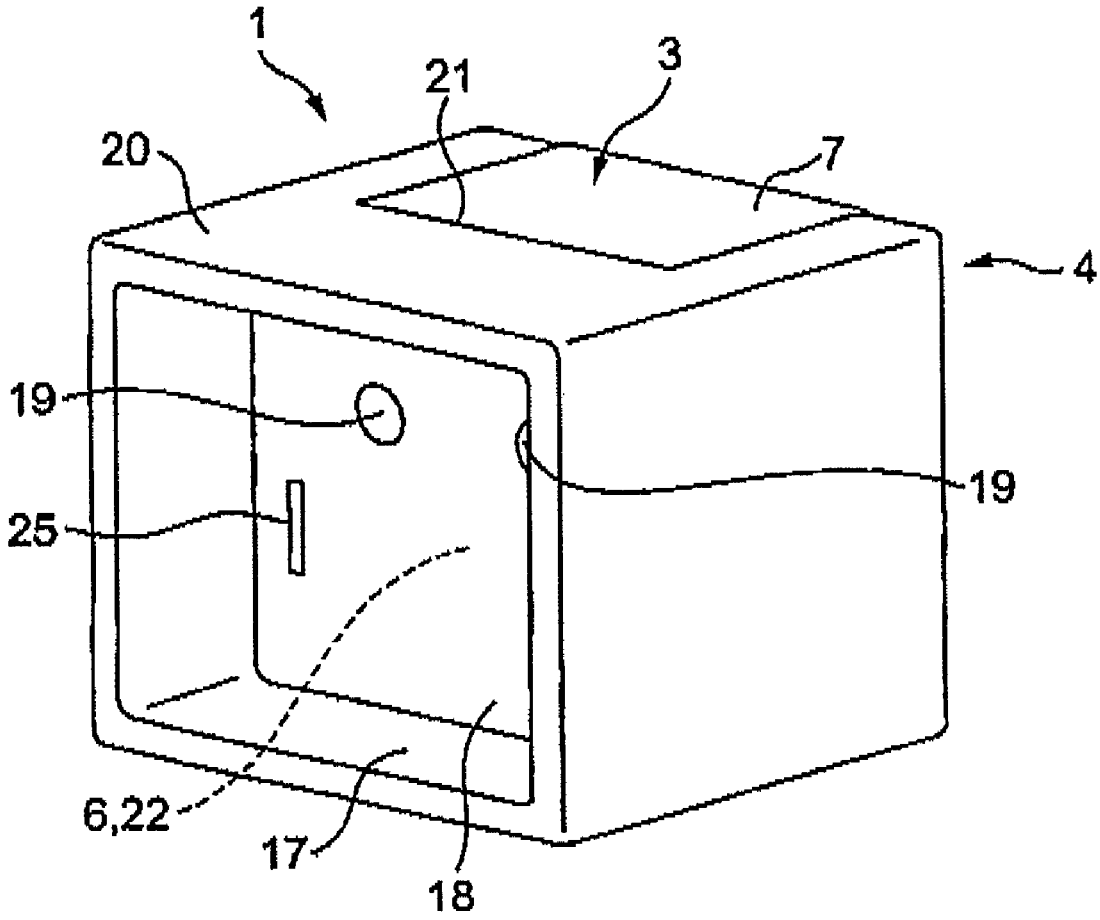
FIG. 5 is a diagram concerning the assembly of the connector and is a perspective view illustrating a state after the insertion of the grounding plate into the connector housing.
Figure 6:
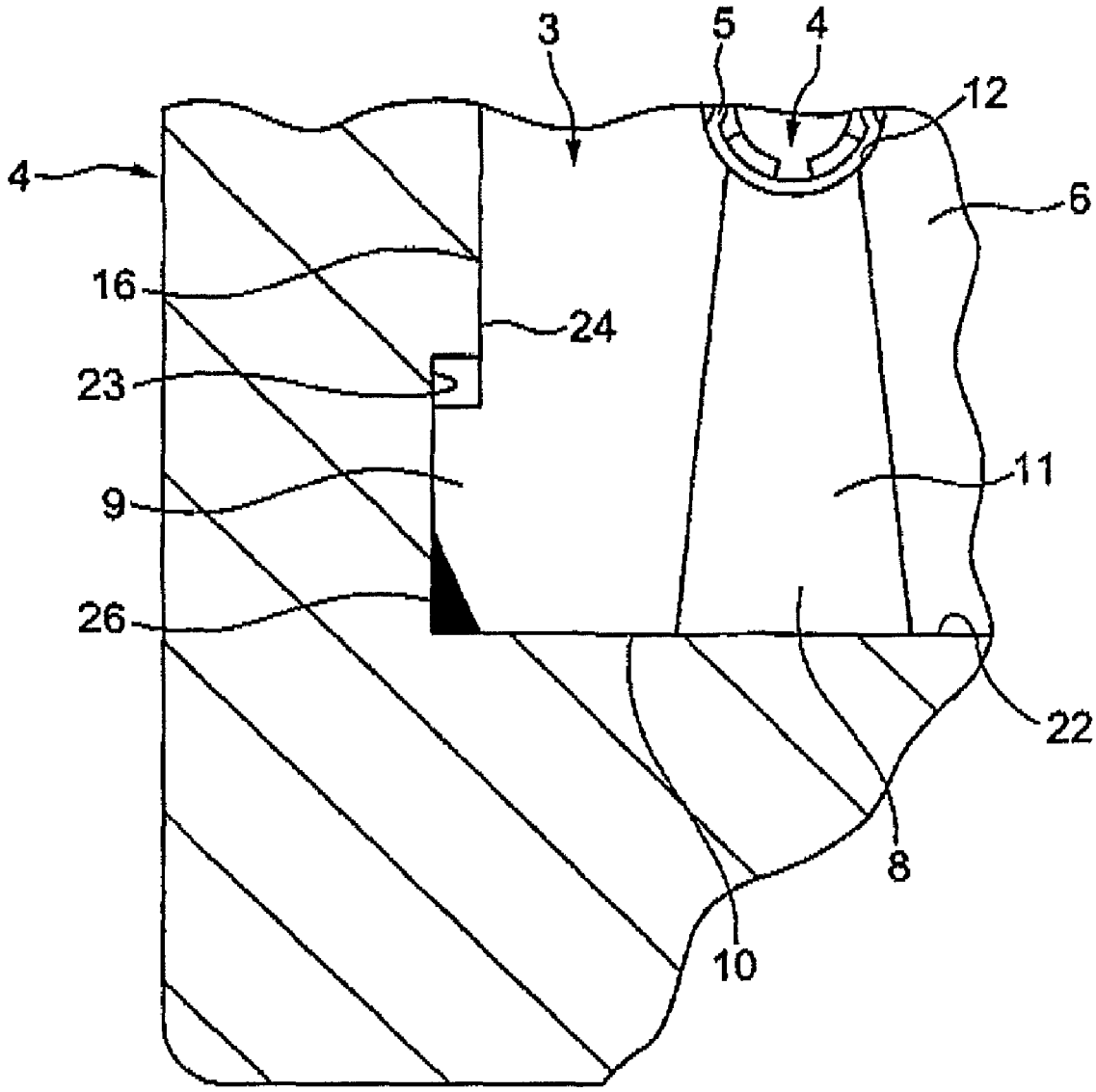
FIG. 6 is an explanatory diagram concerning a jig inserting space.

Hereafter, a description will be given of an embodiment of the invention with reference to the accompanying drawings. FIGS. 1A and 1B are diagrams illustrating the embodiment of the connector in accordance with the invention, in which FIG. 1A is a cross-sectional view illustrating the configuration of the connector and FIG. 1B is a perspective view of a grounding plate. In addition, FIGS. 2A and 2B are diagrams illustrating a connector housing, in which FIG. 2A is a perspective view and FIG. 2B is a cross-sectional view at the position of a terminal inserting/accommodating portion. Further, FIGS. 3 to 5 are diagrams concerning the assembly of the connector, and FIG. 6 is an explanatory diagram concerning a jig inserting space.

In FIGS. 1A and 1B, a connector 1 is comprised of two shield terminals 2, a grounding plate 3, and a connector housing 4 (the number of the shield terminals 2 is exemplary). The connector 1 is adapted to be able to prevent the radiation of unwanted electromagnetic waves to the outside or the superimposition of external electromagnetic waves on the signal as noise. In addition, as will be appreciated from the description that follows, as compared with conventional connectors, the connector 1 excels in manufacturability and operational efficiency and exhibits high connection reliability.

The shield terminal 2 is provided at a terminal of a coaxial cable and has on its outer side an electrically conductive cylindrical outer conductor terminal 5 (an inner conductor terminal and the like are not shown). The cylindrical outer conductor terminal 5 is an outer conductor terminal having a substantially cylindrical shape, and a portion of it is connected to a braid of the coaxial cable. By working a thin-walled metal sheet into a substantially cylindrical shape, the cylindrical outer conductor terminal 5 is formed.

By working an electrically conductive metal sheet having a relatively large wall thickness, the grounding plate 3 is formed. In this embodiment, the grounding plate 3 is formed into an L-shape having a terminal connecting plate portion 6 and an external connecting plate portion 7. The terminal connecting plate portion 6 is formed as a portion that is brought into contact with the cylindrical outer conductor terminals 5 of the shield terminals 2. Meanwhile, the external connecting plate portion 7 is formed as a portion that is exposed to the outside of the connector (outer surface of the connector housing 4).

In the terminal connecting plate portion 6, two outer conductor terminal press-fitting slits 8 are formed in accordance with the number and layout of the shield terminals 2. In addition, a pair of retaining projections 9 projecting in the widthwise direction of the terminal connecting plate portion 6 are formed on this terminal connecting plate portion 6. The outer conductor terminal press-fitting slits 8 are each formed in such a manner as to notch the terminal connecting plate portion 6 from its end portion 10 toward its portion continuing to the external connecting plate portion 7 (the outer conductor terminal press-fitting slits 8 are formed substantially in such a slit shape as to notch the terminal connecting plate portion 6 in the inserting/removing direction in the drawings).

Each outer conductor terminal press-fitting slit 8 has formed therein a terminal introducing portion 11 as a portion for introducing the cylindrical outer conductor terminal 5 of the shield terminal 2, a terminal crimping portion 12 continuing from this terminal introducing portion 11 and adapted to crimp the cylindrical outer conductor terminal 5 in such a manner as to clamp it, and a slit-width enlargement action portion 13 continuing from the terminal crimping portion 12.

The terminal introducing portion 11 is formed such that the width of the opening at the end portion 10 of the terminal connecting plate portion 6 is large and the width becomes gradually smaller away from that opening. The terminal crimping portion 12 is formed with a substantially circular shape whose diameter is slightly smaller than the diameter of the cylindrical outer conductor terminal 5. The terminal crimping portion 12 has a pair of mutually opposing edge portions 14 at portions continuing from the terminal introducing portion 11.

The slit-width enlargement action portion 13 in this embodiment is formed with a substantially circular shape whose diameter is larger than the diameter of the terminal crimping portion 12 (the shape of the slit-width enlargement action portion 13 is only exemplary). The slit-width enlargement action portion 13 having a substantially circular shape continues to the substantially circular terminal crimping portion 12 via a connecting portion 15. The slit-width enlargement action portion 13 is formed as a portion which imparts resiliency by a greater degree in the widthwise direction of the terminal connecting plate portion 6.

Each retaining projection 9 is formed in such a manner as to project from a side portion 16 of the terminal connecting plate portion 6. Further, the retaining projection 9 is formed at a position close to the end portion 10 of the terminal connecting plate portion 6. The retaining projection 9 in this embodiment is formed in the illustrated shape by having a retaining portion (retaining surface) parallel to the end portion 10, a portion perpendicular to this retaining portion and parallel to the side portion 16, and an inclined portion diagonally connecting this portion and the end portion 10.

The external connecting plate portion 7 is formed in a shape which is rectangular in a plan view and whose obverse and reverse surfaces are flat. The obverse surface of the external connecting plate portion 7 is a surface for grounding, and is adapted to contact, for instance, a bracket to be thereby electrically connected to the bracket. It should be noted that, apart from the contact with a bracket, it is possible to cite as another example of the grounding structure a structure in which the external connecting plate portion 7 is bolted to the chassis.

In FIGS. 1A to and 2B, the connector housing 4 is an insulating molded part made of a synthetic resin, and a fitting recess 17 for effecting fitting with a mating connector is formed in its front surface. Two terminal inserting/accommodating portions 19, each of which has the shape of a circular through hole and into which the shield terminal 2 is inserted and accommodated, are formed in a recessed wall 18 of the fitting recess 17 at a predetermined interval therebetween. Each terminal inserting/accommodating portion 19 is formed in conformity with the diameter of the cylindrical outer conductor terminal 5 of the shield terminal 2. In addition, each terminal inserting/accommodating portion 19 is formed in such a manner as to penetrate from the recessed wall 18 to a rear surface of the connector housing 4.

An outer surface-side plate accommodating portion 21 for accommodating the external connecting plate portion 7 of the grounding plate 3 is formed in a top surface (outer surface) 20 of the connector housing 4. The outer surface-side plate accommodating portion 21 is formed so as to recess the top surface 20 of the connector housing 4. The outer surface-side plate accommodating portion 21 is formed with such a depth that the obverse surface of the external connecting plate portion 7 becomes flush with the top surface 20 when the external connecting plate portion 7 is accommodated.

A plate inserting/accommodating portion 22 is formed in the connector housing 4. The plate inserting/accommodating portion 22 is formed into such a shape that the terminal connecting plate portion 6 of the grounding plate 3 can be inserted therein in such a way as to traverse the terminal inserting/accommodating portion 19 and is accommodated therein. The plate inserting/accommodating portion 22 is formed such that one end thereof is open to the outer surface-side plate accommodating portion 21. The plate inserting/accommodating portion 22 is formed so as to be perpendicular to the outer surface-side plate accommodating portion 21 and to the terminal inserting/accommodating portion 19.

A pair of plate retaining recesses 23 for retaining the retaining projections 9 of the grounding plate 3 are formed in the above-described plate inserting/accommodating portion 22. Each plate retaining recess 23 is formed so as to recess a side portion 24 of the plate inserting/accommodating portion 22 in the widthwise direction of the connector housing 4 (i.e., is formed so as to be recessed in a rectangular shape). In the plate retaining recess 23, a housing-side retaining portion is formed at a position opposing the retaining portion (retaining surface) of the retaining projection 9. The plate retaining recess 23 is formed by a die-cut slot 25 which reaches the plate inserting/accommodating portion 22 from the recessed wall 18 of the fitting recess 17.

On the basis of the above-described configuration and construction, a description will be given of the method of assembling the connector 1.

First, if the shield terminals 2 are inserted into the respective terminal inserting/accommodating portions 19 of the connector housing 4, the inserted state of the shield terminals 2 is held with their cylindrical outer conductor terminals 5 contacting inner surfaces of the terminal inserting/accommodating portions 19 (illustration is omitted; reference may be had to FIG. 1A).

Next, as shown in FIG. 3, the grounding plate 3 is set above the connector housing 4, and the grounding plate 3 is subsequently lowered to insert the terminal connecting plate portion 6 of the grounding plate 3 into the plate inserting/accommodating portion 22 of the connector housing 4 (see FIG. 4). When the terminal connecting plate portion 6 is further inserted and is fully accommodated in the plate inserting/accommodating portion 22, at this time or in this process the cylindrical outer conductor terminals 5 are thrust into the outer conductor terminal press-fitting slits 8 of the terminal connecting plate portion 6, and the terminal connecting plate portion 6 and the cylindrical outer conductor terminals 5 are connected to each other by crimping. Further, the retaining projections 9 of the terminal connecting plate portion 6 are retained by the plate retaining recesses 23 of the plate inserting/accommodating portion 22, thereby fixing the position of the grounding plate 3.

When the position of the grounding plate 3 is fixed, the shield terminals 2 are held by this grounding plate 3. The shield terminals 2 are held with high terminal holding forces by virtue of the holding structure of metals based on the terminal connecting plate portion 6 and the cylindrical outer conductor terminals 5.

The cylindrical outer conductor terminals 5 are crimped in a state of being clamped by the terminal crimping portions 12 of the outer conductor terminal press-fitting slits 8. Since the terminal connecting plate portion 6 comes to possess a spring characteristic by virtue of the configuration of the outer conductor terminal press-fitting slits 8, the terminal connecting plate portion 6 is resiliently connected to the cylindrical outer conductor terminals 5. As the shield terminals 2 are crimped by the terminal connecting plate portion 6, and by virtue of the aforementioned holding structure of the metals, the shield terminals 2 are held inside the connector housing 4 in a state of being difficult to be displaced.

As for the grounding plate 3 whose connection to the cylindrical outer conductor terminals 5 is completed, since the external connecting plate portion 7 is exposed to outside the connector, as shown in FIG. 5, the grounding plate 3 can be grounded to, for instance, a bracket or the like through this external connecting plate portion 7.

In the invention, when the external connecting plate portion 7 of the grounding plate 3 is flush with the top surface 20 of the connector housing 4, the terminal connecting plate portion 6 of the grounding plate 3 and the cylindrical outer conductor terminals 5 of the shield terminals 2 are connected to each other inside the connector housing 4 by crimping. Accordingly, the state of connection inside the connector housing 4 can be grasped by the position of the external connecting plate portion 7 (in a case where the external connecting plate portion 7 is not flush with the top surface 20 of the connector housing 4, the above-described crimping is not completed, so that the terminal connecting plate portion 6 is continued to be inserted).

It should be noted that in a case where the disassembly of the connector 1 is carried out, it suffices if a retention releasing jig (an un-illustrated rod-like jig) is inserted into the die-cut slot 25, and this retention releasing jig is operated in a jig inserting space 26 (the filled portion in FIG. 6) formed between the retaining projection 9 of the terminal connecting plate portion 6 and the plate retaining recess 23 of the plate inserting/accommodating portion 22. After releasing the state of retention, the grounding plate 3 is first removed, and the shield terminals 2 are then removed, thereby disassembling the connector 1 into respective parts.

As described above with reference to FIG. 1A to FIG. 6, according to the invention, since the shield terminals 2 and the grounding plate 3 are separate, an advantage is offered in that it is possible to improve the manufacturability of the shield terminals 2 over conventional examples. In addition, according to the invention, since the assembling structure is such that the shield terminals 2 and the grounding plate 3 are inserted into the connector housing 4, an advantage is offered in that the connector 1 can be made easy to operate. Further, according to the invention, since the terminal connecting plate portion 6 and the cylindrical outer conductor terminals 5 are brought into pressure contact with each other for crimping, and the terminal connecting plate portion 6 is resiliently connected to the cylindrical outer conductor terminals 5, an advantage is offered in that the connector 1 can be made highly reliable in connection. Furthermore, according to the invention, since the holding structure of the metals is adopted in which the shield terminals 2 are held by the grounding plate 3, an advantage is offered in that the connector 1 can be provided with high terminal holding forces.

Figure 7:
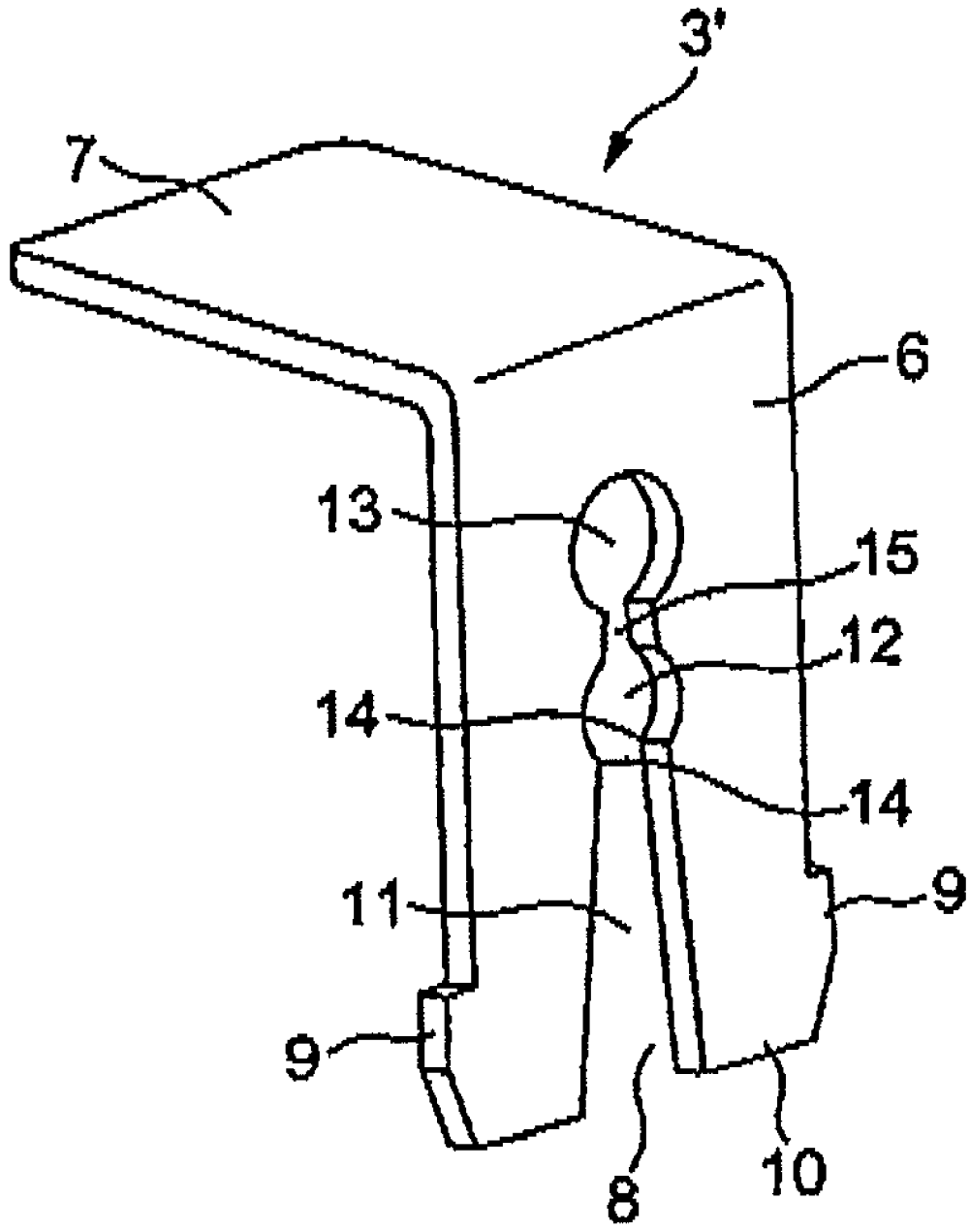
FIG. 7 is a perspective view illustrating another example of the grounding plate.

Next, a description will be given of another example of the grounding plate with reference to FIG. 7. FIG. 7 is a perspective view illustrating the other example (those portions that are identical to those of the above description will be denoted by the same reference numerals).

In FIG. 7, a grounding plate 3' is formed in an L-shape having the terminal connecting plate portion 6 and the external connecting plate portion 7. One outer conductor terminal press-fitting slit 8 is formed in the terminal connecting plate portion 6. The pair of retaining projections 9 projecting in the widthwise direction of the terminal connecting plate portion 6 are formed on this terminal connecting plate portion 6. The outer conductor terminal press-fitting slit 8 has formed therein the terminal introducing portion 11, the terminal crimping portion 12, and the slit-width enlargement action portion 13, the edge portions, and the connecting portion 15. In the invention, it is possible to use such a grounding plate 3'.

In addition, although not particularly shown, a recess or recesses into which an edge or edges of the outer conductor terminal press-fitting slit 8 of the grounding plate 3 can be inserted may be formed on the cylindrical outer conductor terminal 5 of the shield terminal 2. As the edge or edges of the outer conductor terminal press-fitting slit 8 of the grounding plate 3 are inserted into the aforementioned recess or recesses of the cylindrical outer conductor terminal 5, the shield terminal 2 is held inside the connector housing 4 in a state of being more difficult to be displaced.

It goes without saying that various modifications of the invention may be made without departing from the spirit of the invention.

What is claimed is:

1. A connector, comprising:

a shield terminal provided at a terminal of a coaxial cable and having an electrically conductive cylindrical outer conductor terminal on an outer side of the shield terminal;

an electrically conductive grounding plate having a terminal connecting plate portion that is brought into contact with the cylindrical outer conductor terminal and an external connecting plate portion that is exposed to an outside of the connector; and an insulating connector housing having a terminal inserting/accommodating portion that has a shape of a circular through hole and into which the shield terminal is inserted and is accommodated and a plate inserting/accommodating portion into which the terminal connecting plate portion is inserted so as to traverse the terminal inserting/accommodating portion and is accommodated, wherein an outer conductor terminal press-fitting slit which has a terminal introducing portion for introducing the cylindrical outer conductor terminal, a terminal crimping portion continuing from the terminal introducing portion and adapted to crimp the cylindrical outer conductor terminal so as to clamp the cylindrical outer conductor terminal, and a slit-width enlargement action portion continuing from the terminal crimping portion is formed in the terminal connecting plate portion.

2. The connector according to claim 1, wherein an outer surface-side plate accommodating portion for accommodating the external connecting plate portion is formed in an outer surface of the connector housing, the outer surface-side plate accommodating portion being formed such that the external connecting plate portion becomes flush with the outer surface in a state in which the terminal connecting plate portion is fully inserted into the plate inserting/accommodating portion.

3. The connector according to claim 1, wherein a retaining projection projecting in a widthwise direction of the terminal connecting plate portion are formed on the terminal connecting plate portion, and a plate retaining recess for retaining the retaining projection is formed in the connector housing by a die-cut slot which reaches the plate inserting/accommodating portion.

4. The connector according to claim 3, wherein the plate retaining recess is formed into such a shape that a jig inserting space is formed between the retaining projection and the plate retaining recess in a state in which the retaining projection is retained.

* * * * *